US009587418B2

(12) United States Patent
Choi

(10) Patent No.: US 9,587,418 B2
(45) Date of Patent: Mar. 7, 2017

(54) DOOR INSIDE HANDLE APPARATUS WITH PULL HANDLE

(71) Applicant: Hyundai Motor Company, Seoul (KR)

(72) Inventor: Dong Wuk Choi, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 294 days.

(21) Appl. No.: 14/292,625

(22) Filed: May 30, 2014

(65) Prior Publication Data

US 2015/0167348 A1 Jun. 18, 2015

(30) Foreign Application Priority Data

Dec. 17, 2013 (KR) ..... 10-2013-0157644

(51) Int. Cl.

| | |
|---|---|
| ***E05B 3/00*** | (2006.01) |
| ***E05B 85/12*** | (2014.01) |
| ***E05B 85/10*** | (2014.01) |
| *E05B 1/00* | (2006.01) |

(52) U.S. Cl.

CPC ..... *E05B 85/12* (2013.01); *E05B 85/10* (2013.01); *Y10S 292/56* (2013.01); *Y10T 292/57* (2015.04)

(58) Field of Classification Search

CPC ..... E05B 85/10; E05B 85/12; Y10S 292/56

USPC ..... 292/336.3

See application file for complete search history.

(56) References Cited

U.S. PATENT DOCUMENTS 1,567,662 A * 12/1925 Mack ..... E05B 85/10 292/34
2,209,551 A * 7/1940 Anderson ..... E05B 85/22 292/224
2,304,145 A * 12/1942 Borchers ..... E05C 1/14 292/227
2,591,822 A * 4/1952 Jakeway ..... E05B 7/00 292/336.3
2,872,235 A * 2/1959 Brueder ..... E05B 85/12 292/336.3
3,020,075 A * 2/1962 Johnstone ..... E05B 85/14 16/412
4,054,307 A * 10/1977 Carella ..... E05B 77/46 292/336.3
4,216,983 A * 8/1980 Hough ..... B60J 7/1642 292/263
4,482,179 A * 11/1984 Johnson ..... E05B 1/0038 292/336.3

(Continued)

FOREIGN PATENT DOCUMENTS

DE 19837662 A1 * 4/1999 ..... E60J 5/0413
JP 63-127569 U 8/1988

(Continued)

*Primary Examiner* — Carlos Lugo
(74) *Attorney, Agent, or Firm* — Morgan, Lewis & Bockius LLP

(57) ABSTRACT

A door inside handle apparatus with a pull handle may include a handle bracket, a door inside handle and a link lever. The handle bracket may be fixed to the pull handle without interfering with a storage space of the pull handle. The door inside handle may be coupled to the handle bracket to be turned and have an operation part exposed through a rear side of the pull handle and to be operated by a user. The link lever may be coupled to the handle bracket to be turned, connected with one end of a latch cable, and operated to pull the latch cable by rotating with the door inside handle.

4 Claims, 4 Drawing Sheets

(56) References Cited

U.S. PATENT DOCUMENTS

| | | | | | |
|---|---|---|---|---|---|
| 4,487,441 | A * | 12/1984 | Miyamoto | E05B 77/265 | 292/216 |
| 5,020,838 | A * | 6/1991 | Fukumoto | E05B 81/14 | 292/201 |
| 5,183,302 | A * | 2/1993 | Pelachyk | E05B 85/12 | 292/336.3 |
| 5,531,489 | A * | 7/1996 | Cetnar | E05B 85/12 | 292/225 |
| 5,544,925 | A * | 8/1996 | Ikeda | E05B 17/0012 | 292/216 |
| 6,598,912 | B2 * | 7/2003 | Hillgaertner | E05B 13/005 | 292/225 |
| 7,195,292 | B2 * | 3/2007 | Ketelsen | E05B 85/26 | 292/201 |
| 7,387,321 | B2 * | 6/2008 | Tanaka | E05B 77/04 | 292/336.3 |
| 7,434,854 | B2 * | 10/2008 | Fujimatsu | E05B 81/25 | 292/201 |
| 9,175,505 | B2 * | 11/2015 | Hirukawa | E05B 85/18 | |
| 2008/0073919 | A1 * | 3/2008 | Soda | E05B 41/00 | 292/336.3 |
| 2014/0217756 | A1 * | 8/2014 | Tanoguchi | E05B 77/38 | 292/336.3 |

FOREIGN PATENT DOCUMENTS

| | | | | |
|---|---|---|---|---|
| KR | 10-1998-0044279 | A | 9/1998 | |
| KR | 10-2004-0095433 | A | 11/2004 | |
| KR | 10-2005-0112830 | A | 12/2005 | |
| KR | 10-2011-0139353 | A | 12/2011 | |
| KR | 10-2013-0070028 | A | 6/2013 | |
| SE | 2687654 | A2 * | 1/2014 | E05B 79/20 |

* cited by examiner

DOOR INSIDE HANDLE APPARATUS WITH PULL HANDLE

CROSS-REFERENCE TO RELATED APPLICATION

The present application claims priority of Korean Patent Application Number 10-2013-0157644 filed on Dec. 17, 2013, the entire contents of which application are incorporated herein for all purposes by this reference.

BACKGROUND OF INVENTION

Field of Invention

The present invention relates to a door inside handle apparatus with a pull handle, and more particularly, to a door inside handle apparatus with a pull handle which is combined with a pull handle without reducing the storage space of the pull handle.

Description of Related Art

As shown in FIG. 1, on the inner side of a door trim 1 in a common vehicle, a door inside handle 2 that a user operates to open the door is disposed to be turn and a pull handle 3 into which a user puts a hand to pull the open door is disposed.

The door inside handle 2 is connected with a door latch through a latch cable, so when a user turns the door inside handle 2 by pulling it, the latch cable is pulled and the door latch is unlocked, and accordingly, the door is opened. The pull handle 3 is usually fixed to a door armrest 4.

However, the existing structure in which the door inside handle 2 and the pull handle 3 are separately disposed, as described above, has a defect that there are many work processes and particularly the door trim 1 cannot be freely designed because the door inside handle 2 is disposed in the door trim 1, so that it cannot contribute for an elegant image of a vehicle.

The door inside handle 2 is disposed in the storage space of the pull handle 3, as in FIG. 2, as a plan for solving this problem. However, there are defects that it is inconvenient to operate the door inside handle 2 due to the small space of the pull handle 3, that the door inside handle 2 reduces the storage space of the pull handle 3, and that particularly when stuffs are in the storage space of the pull handle 3, the stuffs are stuck in the door inside handle 2 and interfere with the operation of the door inside handle 2.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to allow for more free design of a door trim and contribute for elegant image of a vehicle by providing a door inside handle apparatus combined with a pull handle without reducing the storage space of the pull handle.

Various aspects of the present invention provide a door inside handle apparatus with a pull handle, which includes: a handle bracket fixed to the pull handle without interfering with a storage space of the pull handle; a door inside handle coupled to the handle bracket to be turned and having an operation part, which is to be operated by a user, exposed through a rear side of the pull handle; a link lever coupled to the handle bracket to be turned, connected with one end of a latch cable, operated to pull the latch cable by rotating with the door inside handle.

The apparatus may further include a return spring having one end coupled to a handle shaft, which is a turning center of the door inside handle, and the other end connected to the handle bracket, and providing a return force when the door inside handle is turned.

The operation part of the door inside handle may include an operation protrusion and an operation groove formed substantially vertically adjacent to each other, wherein the operation protrusion may be exposed to an outside of the pull handle through a through-hole formed in the rear side of the pull handle.

The apparatus may further include a damper fitted in the through-hole for absorbing shock and reducing noise when it comes in contact with the operation protrusion due to the operation of the door inside handle.

A locking step for contact with the link lever may be integrally formed on the door inside handle. The link lever may include a pivot center pivotably coupled to the handle bracket by a lever shaft, a cable connection portion extending to one side from the pivot center and connected with one end of the latch cable, and a handle contact portion extending to the other side from the pivot center and contacting with the locking step of the door inside handle. The lever shaft may be disposed at a rear side of the handle shaft to facilitate contact of the handle contact portion of the link lever with the locking step.

According to the present invention, since a door inside handle that operates a door latch in a vehicle is integrated with a pull handle without interfering with a storage space of the pull handle, there is no need of providing a specific space for the door inside handle on a door trim. Therefore, it is possible to more freely design a door trim, so that it contributes for elegant image of a vehicle.

Further, according to the present invention, since only the operation protrusion of the door inside handle which a user operates with a hand is exposed to the outside of the pull handle, it is possible to conveniently operate the door inside handle, and particularly, the exposed portion can be minimized so that the external appearance can be improved.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrating the accompanying drawings which are given herein below by way of illustration only, and thus are not limitative of the present invention, and wherein.

Figure 1:
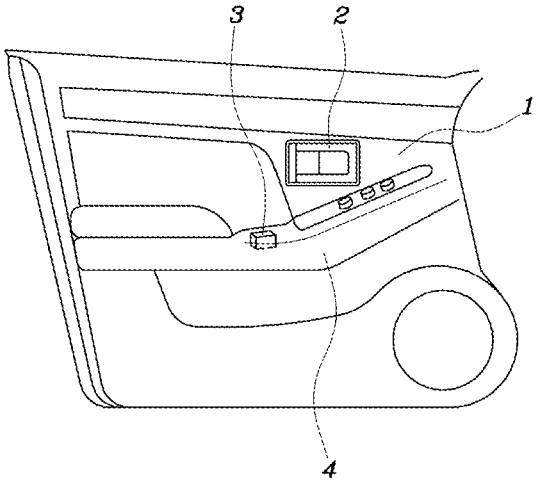
FIG. 1 (Prior Art)
FIG. 1 is a view illustrating an existing structure with a door inside handle and a pull handle separately disposed.
Figure 2:
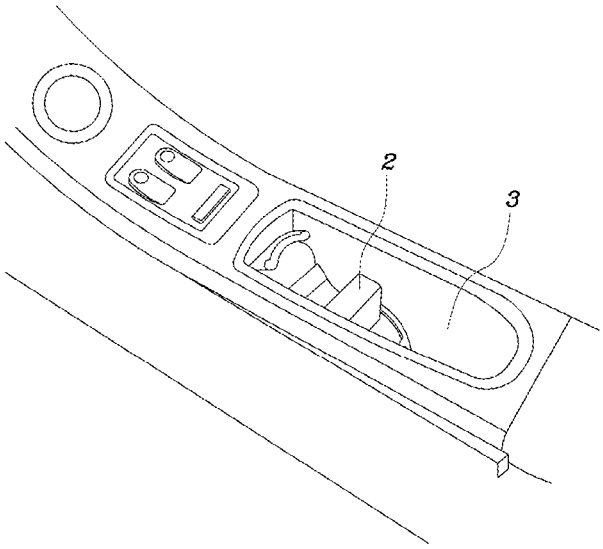
FIG. 2 (Prior Art)
FIG. 2 is a view illustrating an existing structure with a door inside handle in a storage space of a pull handle.

It should be understood that the appended drawings are not necessarily to scale, presenting a somewhat simplified representation of various preferred features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A door inside handle apparatus with a pull handle according to embodiments of the present invention is described hereafter in detail with reference to the accompanying drawings.

Figure 3:
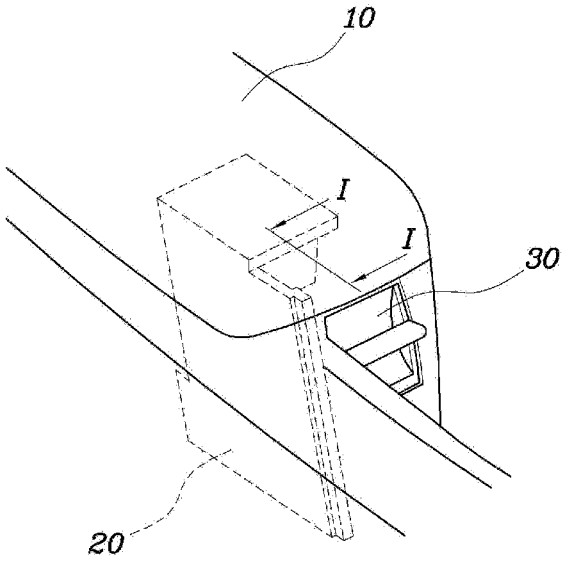
FIG. 3 is a view showing that an exemplary door inside handle is disposed in an exemplary pull handle in accordance with the present invention.
Figure 4:
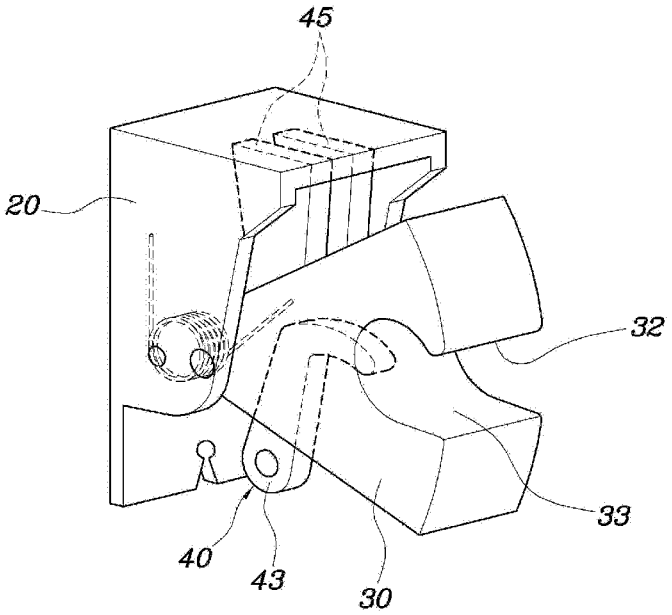
FIG. 4 is a perspective view of an exemplary door inside handle apparatus with an exemplary pull handle according to the present invention.
Figure 5:
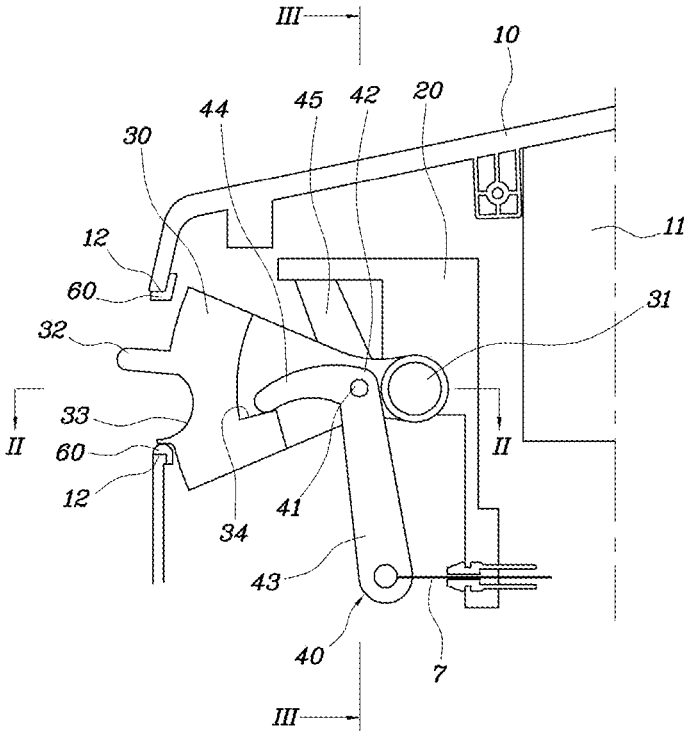
FIG. 5 is a cross-sectional view taken along line I-I of FIG. 3.
Figure 6:
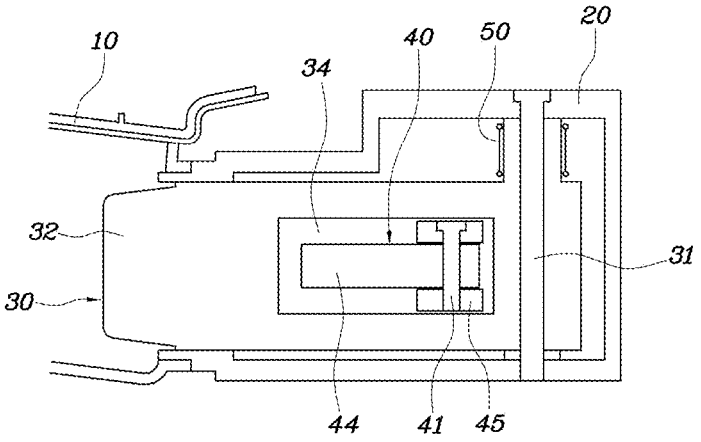
FIG. 6 is cross-sectional view taken along line II-II of FIG. 5.
Figure 7:
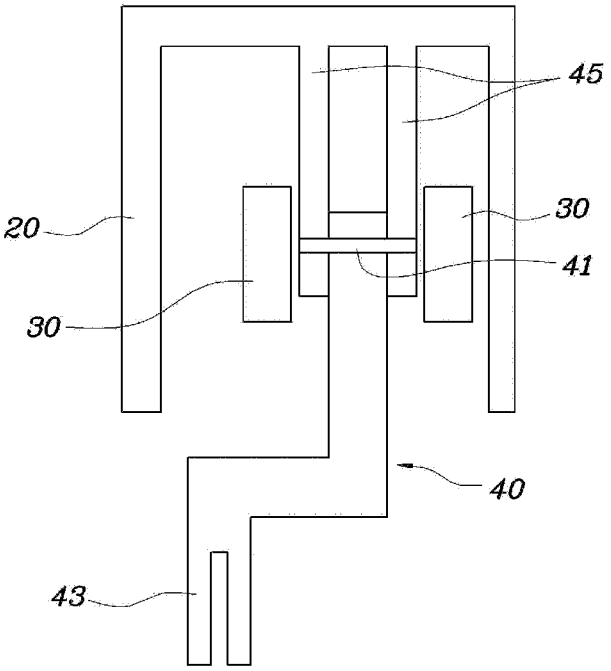
FIG. 7 is cross-sectional view taken along line III-III of FIG. 5.

A door inside handle apparatus with a pull handle according to the present invention, as shown in FIGS. 3 to 7, includes: a handle bracket 20 fixed to a pull handle 10 without interfering with a storage space 11 of the pull handle 10; a door inside handle 30 coupled to the handle bracket 20 to be turned and having an operation part, which is operated by a user, exposed through the rear side of the pull handle 10; a link lever 40 coupled to the handle bracket 20 to be turned, connected with one end of a latch cable 7, and operated to pull the latch cable 7 by rotating with the door inside handle 30; and a return spring 50 having one end coupled to a handle shaft 31, which is the turning center of the door inside handle 30, the other end connected to the handle bracket 20, and providing a return force when the door inside handle 30 is turned.

The pull handle 10 is fixed to the armrest of a door in general structures, but is not limited thereto.

In the door inside handle 30 of which one end is coupled to the handle shaft 31 and the other end functions as the operation part, an operation protrusion 32 and an operation groove 33 are vertically disposed to be connected on the operation part, or the operation part includes an operation protrusion 32 and an operation groove 33 formed substantially vertically adjacent to each other. The operation protrusion 32 is exposed to the outside through a through-hole 12 formed in the rear side of the pull handle 10.

That is, according to the present invention, only the operation protrusion 32 of the door inside handle 30 which a user touches with a hand is exposed to the outside through the through-hole 12 of the pull handle 10, so that the exposed portion is minimized and the external appearance can be improved. The operation protrusion 32 of the door inside handle 30 prevents the user's hand from sliding and the operation groove 33 has an arc cross-section, so it allows a user to more conveniently grip the handle.

The present invention further includes a damper 60 fitted in the through-hole 12 of the pull handle 10, and absorbing shock and preventing noise when it comes in contact with the operation protrusion 32 due to the operation of the door inside handle 30. The damper 60 may be made of rubber, silicon, plastic resin etc., but is not limited thereto.

A locking step 34 for contact with the link lever 40 is integrally or monolithically formed on the door inside handle 30 and it may be formed at a position between the handle shaft 31 and the operation groove 33.

The link lever 40 has a pivot center 42 coupled to the handle bracket 20 to pivot by a lever shaft 41, a cable connection portion 43 extending to a side from the pivot center 42 and connected with one end of the latch cable 7, and a handle contact portion 44 extending to the other side from the pivot center 42 and contacting with the locking step 34 of the door inside handle 30.

For easy contact of the handle contact portion 44 of the link lever 40 with the locking step 34 of the door inside handle 30, the lever shaft 41 may be disposed behind further than the handle shaft 31, and to this end, a specific lever mounting bracket 45 may be used. That is, the lever mounting bracket 45 may be coupled to the handle bracket 10 and the pivot center 42 of the link lever 40 may be coupled to the lever mounting bracket 45 to pivot by the lever shaft 41.

As described above, since the door inside handle 30 that operates a door latch in a vehicle is integrated with the pull handle 10 in various embodiments of the present invention, there is no need of providing a specific space for the door inside handle 30 on a door trim. Therefore, it is possible to reduce the work processes and particularly more freely design a door trim, so that it contributes for elegant image of a vehicle.

Further, since only the operation protrusion 32 of the door inside handle 30 which a user operates with a hand is exposed to the outside through the through-hole 12 of the pull handle 10, it is possible to conveniently operate the door inside handle 30, and particularly, the exposed portion can be minimized so that the external appearance can be improved.

Further, since the door inside handle apparatus according to the present invention does not interfere with the storage space 11 of the pull handle 10, it is possible to usefully use the storage space 11 of the pull handle 10.

For convenience in explanation and accurate definition in the appended claims, the terms "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door inside handle apparatus with a pull handle, comprising:

a handle bracket fixed to the pull handle without interfering with a storage space of the pull handle;

a door inside handle coupled to the handle bracket to be turned and having an operation part, which is to be operated by a user, exposed through a rear side of the pull handle; and a link lever coupled to the handle bracket to be turned, connected with a first end of a latch cable, and operated to pull the latch cable by rotating with the door inside handle, wherein a locking step for contact with the link lever is integrally formed on the door inside handle, wherein the link lever includes:

a pivot center pivotably coupled to the handle bracket by a lever shaft;

a cable connection portion extending to a first side from the pivot center and connected with the first end of the latch cable; and a handle contact portion extending to a second other side from the pivot center and contacting with the locking step of the door inside handle, and wherein the lever shaft is disposed at a rear side of a handle shaft to facilitate contact of the handle contact portion of the link lever with the locking step.

2. The apparatus of claim 1, further comprising:

a return spring having a first end connected to the handle bracket, and a second end coupled to the door inside handle bracket through which the handle shaft, which is a turning center of the door inside handle, is inserted, and providing a return force when the door inside handle is turned.

3. The apparatus of claim 1, wherein the operation part of the door inside handle includes an operation protrusion and an operation groove formed substantially vertically adjacent to each other, wherein the operation protrusion is exposed to an outside of the pull handle through a through-hole formed in the rear side of the pull handle.

4. The apparatus of claim 3, further comprising:

a damper fitted in the through-hole for absorbing shock and reducing noise when the damper comes in contact with the operation protrusion due to operation of the door inside handle.

* * * * *